US006778170B1

(12) United States Patent
Shu et al.

(10) Patent No.: US 6,778,170 B1
(45) Date of Patent: Aug. 17, 2004

(54) GENERATING HIGH QUALITY IMAGES IN A DISPLAY UNIT WITHOUT BEING AFFECTED BY ERROR CONDITIONS IN SYNCHRONIZATION SIGNALS CONTAINED IN DISPLAY SIGNALS

(75) Inventors: Hongjun Shu, Fremont, CA (US); Osamu Kobayashi, Sunnyvale, CA (US); Wen-jyh Wang, San Jose, CA (US)

(73) Assignee: Genesis Microchip Inc., Alviso, CA (US)

( * ) Notice: Subject to any disclaimer, the term of this patent is extended or adjusted under 35 U.S.C. 154(b) by 0 days.

(21) Appl. No.: 09/666,666

(22) Filed: Apr. 7, 2000

(51) Int. Cl.[7] ..... G09G 5/00

(52) U.S. Cl. ..... 345/213; 345/10; 345/87; 348/464; 348/521; 348/538

(58) Field of Search ..... 345/211–213, 204, 345/10, 87, 94, 99, 90; 348/464–468, 513, 521, 524–526, 531, 538, 540, 547

(56) References Cited

U.S. PATENT DOCUMENTS 5,276,458 A * 1/1994 Sawdon ..... 345/698
5,731,798 A * 3/1998 Shin ..... 345/99
5,828,368 A * 10/1998 Jung ..... 345/213
6,037,994 A * 3/2000 Bae ..... 348/510
6,147,682 A * 11/2000 Kim ..... 345/211
6,304,236 B1 * 10/2001 Arai et al. ..... 345/10
6,329,975 B1 * 12/2001 Yamaguchi ..... 345/99
6,337,682 B1 * 1/2002 Hwang ..... 345/213
6,366,292 B1 * 4/2002 Allen ..... 345/611
6,448,963 B1 * 9/2002 Han ..... 345/213

OTHER PUBLICATIONS

Digital Visual Interface DVI by Digital Display Working Group, Apr. 2, 1999 (pp. 1–53).

Video Digital Flat Panel Standard: VESA Digital Flat Panel (DFP) by Video Electronics Standards Association, Feb. 14, 1999 (pp. 1–16).

* cited by examiner

*Primary Examiner*—Henry N. Tran
(74) *Attorney, Agent, or Firm*—Beyer Weaver & Thomas LLP

(57) ABSTRACT

Displaying the images encoded in a display signal which also contains synchronization signals and display enable (DE) signal. The DE signal indicates the time points at which the display data portion of the display signal contains active pixel data elements representing image frames. A display unit generates HDISP and VDISP signals (indicative of the active time in which active pixels and lines are respectively received) based on the DE signal. As the DE signal generally tracks (in the time domain) the active pixel data elements, the active pixel data elements forming image frames are accurately identified, and a superior image quality generally results.

14 Claims, 5 Drawing Sheets

GENERATING HIGH QUALITY IMAGES IN A DISPLAY UNIT WITHOUT BEING AFFECTED BY ERROR CONDITIONS IN SYNCHRONIZATION SIGNALS CONTAINED IN DISPLAY SIGNALS

BACKGROUND OF THE INVENTION

1. Field of the Invention

The present invention relates to display units, and more specifically to a method and apparatus for generating high quality images in a display unit without being affected by error conditions in synchronization signals containing the display signals based on which the images are generated.

2. Related Art

Display units are often used to receive and display image frames contained in a display signal received on a serial communication channel. As used in the present application, display units include both analog display units (typically based on cathode ray tube technology) and digital display units (typically based on flat panels). As is well known, the image frames are represented by pixel data elements encoded within display data portion of the display signal.

Display signals generally also contain synchronization signals which indicate the demarcation of the line boundaries and frame boundaries in the accompanying display data. Examples of such signals include HSYNC (indicating transition to next line) and VSYNC (indicating transition one frame to the another) as is well known in the relevant arts.

Synchronization signals are often used to determine the specific pixel data elements which represent the image frame. That is, among the many pixel data elements contained in the display data, some correspond to the image frame and others correspond to the non-display period also. In many known display units, signals termed as VDISP and HDISP are generated (based on the synchronization signals) which respectively indicate whether an active horizontal line and active pixel data element are presently being received. The active pixels in the active lines represent image to be displayed.

One problem with the use of synchronization signals in generating signals such as VDISP and HDISP is that it may not lead to an accurate and consistent indication of the active pixel data elements (more specifically, the time position of the active pixels). The problem may be due to, for example, the fact that the synchronization signals and the display data are often generated by integrated circuits without appropriate coordination.

The result of such problems is that artifacts are introduced into the displayed images, thereby affecting the image quality. The poor image quality may not be acceptable in some situations. Therefore, what is needed is a method and apparatus which enables the images encoded in the display signals to be displayed without being affected by the status of the synchronization signals.

SUMMARY OF THE INVENTION

The present invention uses a display enable (DE) signal received in a display signal to determine the active pixel data elements representing image frames. The DE signal is generally in one logical state when an active pixel data element is encoded in a display data portion and in another logical state during the non-display period. As the DE signal may be generally expected to track (in time domain) the pixel data elements encoded in the display signal, the active pixel data elements may be accurately identified.

According to an aspect of the present invention, the DE signal is used to first generate alternative synchronization signals which are similar in characteristics to the synchronization signals present in display signals. That is, the alternative display signals (de_hsync and de_vsync) also indicate the transitions across horizontal lines and frames similar to the synchronization signals present in display signals.

The alternative synchronization signals are then used to generate VDISP and HDISP signals, which respectively indicate the time duration in which an active line and pixel data element are being received. Based on the VDISP and HDISP signals, the active pixel data elements (which represent images) are identified from among all the pixel data elements generated from the display data.

According to another aspect of the present invention, a multiplexor is used to select either the alternative synchronization signals or the synchronization received in display signals. The selected signals are used to generate the HDISP and VDISP. That is, if desired, the HDISP and VDISP may be generated based on the synchronization signals received in the display signal also.

Thus, the present invention is suited for use in analog or digital display units which receive displays signals compatible with standards such as Digital Visual Interface (DVI) or Digital Flat Panel (DFP) interface as such standards contain the DE signal used by the present invention.

The present invention enables images of superior quality to be generated as the active pixel data elements can be identified accurately.

The present invention enables a display unit to generate HDISP and VDISP signals based either on DE signal or on HSYNC/VSYNC signals as a multiplexor is provider to select either the HSYNC/VSYNC signals or the alternative synchronization signals generated based on the DE signal.

Further features and advantages of the invention, as well as the structure and operation of various embodiments of the invention, are described in detail below with reference to the accompanying drawings. In the drawings, like reference numbers generally indicate identical, functionally similar, and/or structurally similar elements. The drawing in which an element first appears is indicated by the leftmost digit(s) in the corresponding reference number.

BRIEF DESCRIPTION OF THE DRAWINGS

The present invention will be described with reference to the accompanying drawings, wherein.

DETAILED DESCRIPTION OF THE PREFERRED EMBODIMENTS

1. Overview and Discussion of the Invention

The present invention enables the HDISP and VDISP signals indicative of the active pixels and active horizontal lines to be generated based on a display enable (DE) signal which is also present in a display signal in addition to the synchronization signals. The display enable signal refers to a signal which is in one logical state when pixel data elements representing an image are present in the display data portion, and is in another logical state otherwise.

The DE signal is usually generated by the same integrated circuit as (or at least more tightly coordinated with) that which generates the display data. Accordingly, the HDISP and VDISP signals may accurately point to the active pixel positions, and images of superior quality may be generated as a result.

The present invention is described below in further detail with reference to several examples for illustration. One skilled in the relevant art, however, will readily recognize that the invention can be practiced in other environments without one or more of the specific details, or with other methods, etc. In other instances, well-known structures or operations are not shown in detail to avoid obscuring the invention.

2. Example Environment

In general, the present invention can be implemented in display units which receive a display enable (DE) signal associated with display data in a display signal. However, the invention has particular application in environments in which display signals are compatible with Digital Visual Interface (DVI) or Digital Flat Panel (DFP) interface, well known in the relevant arts. Only the details of DVI and DFP as relevant to the present invention are described in this application. For further details, the reader is referred to public sources entitled, "Digital Visual Interface, Revision 1.0 02" dated April 1999, by Digital Display Working Group (DDWG), and "DFP protocol" from VESA, which are both incorporated in their entirety herewith. Also, the invention may be implemented in hardware, software, firmware, or combination of the like and is described below with reference to a computer system.

Figure 1:
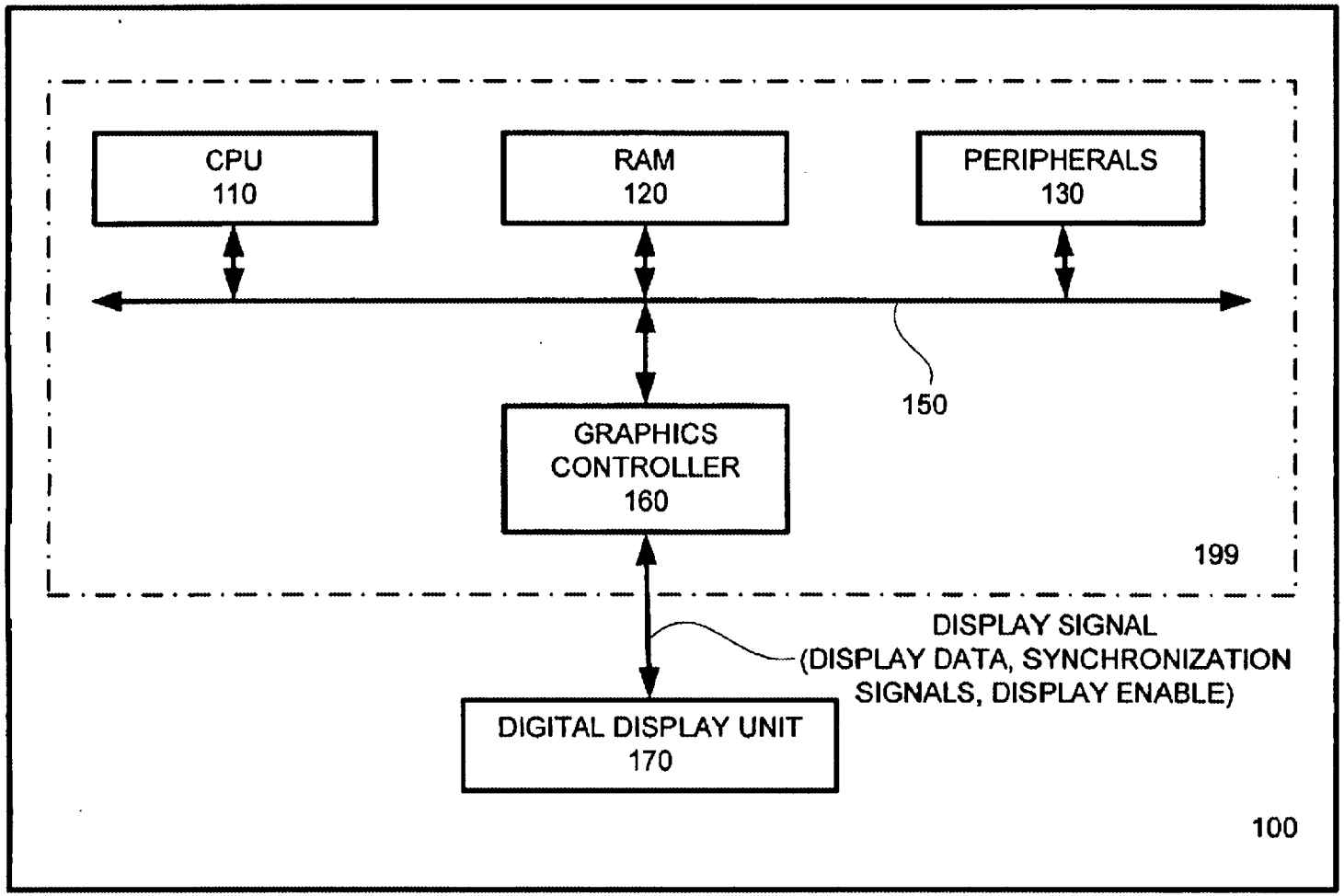
FIG. 1 is a block diagram of a computer system implemented in accordance with the present invention.

FIG. 1 is a block diagram of computer system 100 illustrating an example environment in which the present invention can be implemented. Computer system 100 includes central processing unit (CPU) 110, random access memory (RAM) 120, one or more peripherals 130, graphics controller 160, and digital display unit 170. CPU 110, RAM 120 and graphics controller 160 are typically packaged in a single unit, and such a unit is referred to as source 199 as the unit generates and transmits a sequence of symbols on a serial communication channel. All the components in graphics source 199 of computer system 100 communicate over bus 150, which can in reality include several physical buses connected by appropriate interfaces.

RAM 120 stores data representing commands and possibly pixel data elements representing a source image. CPU 110 executes commands stored in RAM 120, and causes different commands and pixel data elements to be transferred to graphics controller 160. Peripherals 130 can include storage components such as hard-drives or removable drives (e.g., DVD drive, floppy-drives). Peripherals 130 can be used to store commands and/or data which enable computer system 100 to operate in accordance with the present invention. By executing the stored commands, CPU 110 provides the electrical and control signals to coordinate and control the operation of various components in graphics source 199.

Graphics controller 160 receives data/commands from CPU 110, and generates pixel data elements representative of source image frames to be displayed on digital display unit. Graphics controller 160 then encodes the data as symbols and sends the data in the form of a serial communication channel. In parallel, a display enable (DE) signal is also sent indicating the specific time durations in which the pixel data elements representing an image frame or present. The display signal may be transferred to display unit 170 according to standards such as Digital Flat Panel (DFP) and Digital Video Interface (DVI) well known in the relevant arts. As may be appreciated, the display signal may contain synchronization signals such as VSYNC and HSYNC well known in the relevant arts.

Display unit 170 receives a display signal containing display data, synchronization signals and display enable (DE) signal from graphics controller 160, and displays the source images represented by the display signal as described below with several examples. In particular, display unit 170 is described as using the display enable (DE) signal to generate the HDISP and VDISP signals indicating time duration in which active pixels are received.

3. Example Display Unit

Figure 2:
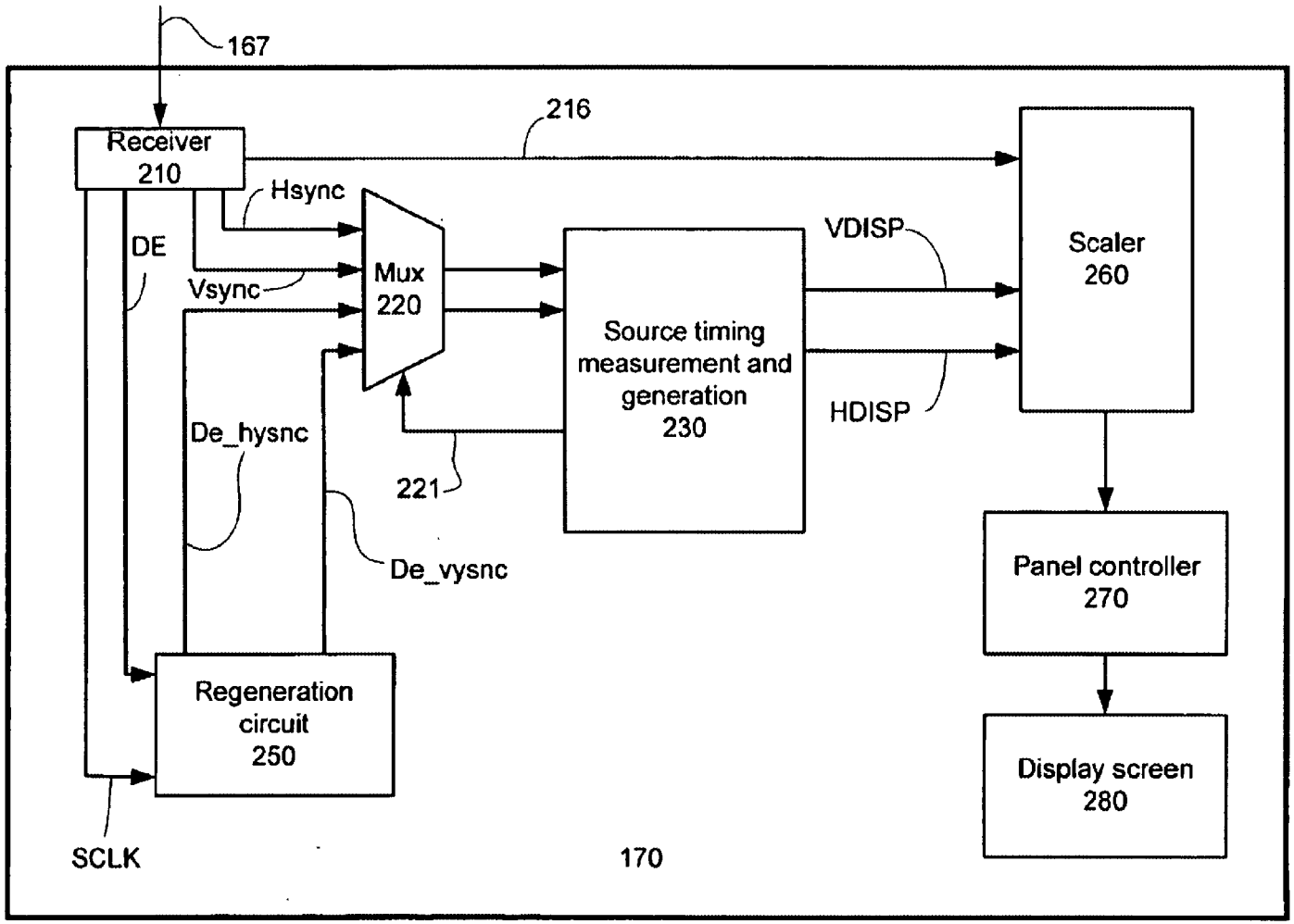
FIG. 2 a block diagram illustrating the details of a display unit implemented in accordance with the present invention.

FIG. 2 is a block diagram illustrating an example embodiment of display unit 170. Display unit 170 is shown containing receiver 210, multiplexor 220, source timing measurement and generation circuit 230, regeneration circuit 250, scaling circuit 260, panel controller 270 and display screen 280. Each component is described below in further detail.

Receiver 210 receives display signals containing display data, a display enable (DE) signal, and synchronization signals on path 167 in the form of a serial communication channel. Receiver 210 recovers the pixel data elements from the display data and sends the pixel data elements to scaling circuit 260 on path 216. Receiver 210 may recover the DE and synchronization signals (e.g., HSYNC and VSYNC), and generate a source clock SCLK (also known as recovered dot clock) based on the components of the display signal in a known way.

Receiver 210 may forward the synchronization signals HSYNC and VSYNC to multiplexor 220. Receiver 210 may further provide the SCLK and DE signal to regeneration circuit 250. In one embodiment, receiver 210 is implemented according to the transition minimized differential signal (TMDS) standard, and may be implemented in a known way.

Regeneration circuit 250 receives the DE signal and the SCLK signal, and generates DE_HSYNC and DE_VSYNC signals which respectively resemble the HSYNC and VSYNC signals received on path 167. The DE_HSYNC and DE_VSYNC signals are generated based on the DE signal as described below with reference to FIG. 3 in further detail. As described in further detail, the DE_HSYNC and DE_VSYNC signals are used to generate the HDISP and VDISP signals, which accurately represent the time duration in which the active pixels are received.

Multiplexor 220 receives HSYNC, VSYNC, DE_HSYNC and DE_VSYNC. Multiplexor 220 selects either the HSYNC signal or the DE_HSYNC signal under the control of select line 221. Similarly, multiplexor 220 selects either the VSYNC signal or the DE_VSYNC signal under the control of select line 221. Multiplexor 220 may be integrated within source timing measurement and generation circuit 230.

Source timing measurement and generation circuit 230 receives the synchronization signals (either those received on path 167 or those generated by regeneration circuit 250), and generates the HDISP and VDISP signals. As noted above, the HDISP signal indicates the time duration when an active pixel is present within a line and VDISP indicates the time duration when an active horizontal line is being received.

In an embodiment, source timing measurement and generation circuit 230 contains a micro-controller having access to a table. In an alternative embodiment, the micro-controller may be implemented external to source timing measurement and generation circuit 220. The table stores various parameter values for different modes (VGA, XVGA, etc.) in which the display frames are received on path 167. Based on parameters such as HTOTAL (number of total pixels within a horizontal line), VTOTAL (the number of lines within a frame), the refresh rate, etc., the micro-controller determines the appropriate timing parameter values for processing the display signal.

Source timing measurement and generation circuit 220 further contains registers for storing the corresponding parameter values. The micro-controller stores the data values accessed from the table into the registers. Another portion of the source timing measurement and generation circuit 220 generates the HDISP and VDISP signals based on the values stored in the register.

It should be understood that the DE_HSYNC and DE_VSYNC signals are respectively very similar to HSYNC and VSYNC signals received on path 167, and thus source timing measurement and generation circuit 230 may be implemented similar to those in prior art display units. Accordingly, source timing measurement and generation circuit 230 may also be implemented in a known way.

Scaling circuit 260 receives the pixel data elements recovered by receiver 210 on path 216. Some of the pixels correspond to the non-display period and others to the display period. HDISP and VDISP signals together indicate which pixels correspond to the display period, and thus represent the images encoded in the display signal received on path 167. Scaling circuit 260 processes the active pixels to either upscale or downscale the image as desired (for example to make full use of space on screen 280). The resulting pixel data elements are passed to panel controller 270.

Panel controller 270 causes the display of images represented by the pixel data elements received from scaling circuit 260. The display is generated on display screen 280. Panel controller 270 generally needs to be implemented consistent with the implementation of display screen 280. Both panel controller 270 and display screen 280 can be implemented in a known way.

As the synchronization signals generated by regeneration circuit 250 more accurately represent the beginning of the active display portions than the synchronization signals received on path 167, images of superior quality may be generated on display screen 280 in accordance with the present invention. An embodiment of regeneration circuit 250 is described below in further detail.

3. Example Regeneration Circuit

Figure 3:
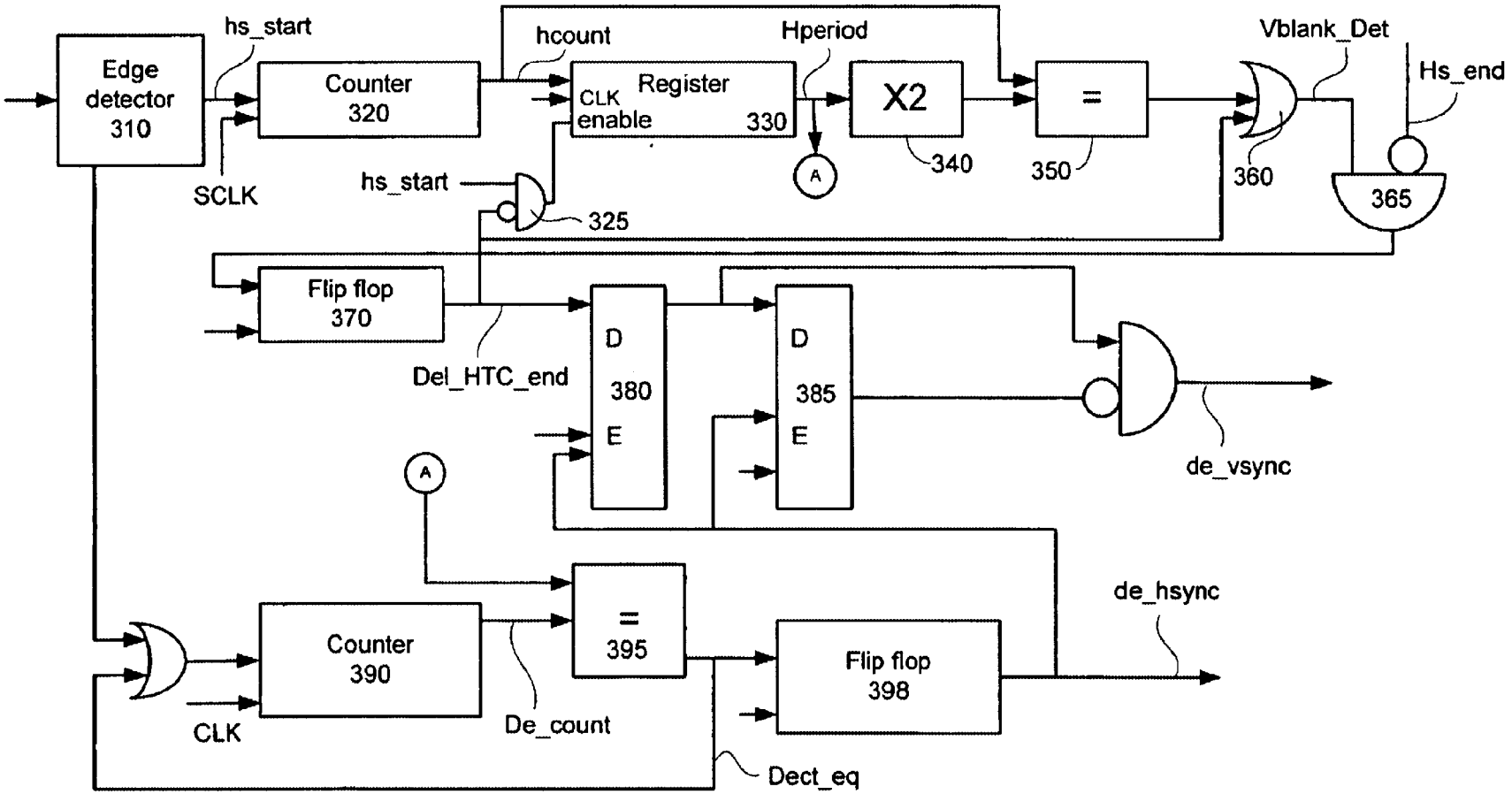
FIG. 3 is a block diagram of a regeneration circuit which generates synchronization signals which are similar to HSYNC and VSYNC in accordance with the present invention.

FIG. 3 is a block diagram illustrating the details of regeneration circuit 250 in one embodiment. Regeneration circuit 250 is shown containing edge detector 310, counter 320, AND gate 325, register 330, multiplier 340, comparator 350, OR gate 360, AND gate 365, flip-flops 370, 380 and 385, AND gate 388, OR gate 315, counter 390, comparator 395, and flip-flop 398. The operation of each component is described with further reference to the timing diagram of FIG. 4. When not expressly noted, each component is clocked by the SCLK signal.

Edge detector 310 receives DE signal on the PLDE input. A high logical level on PLDE input indicates that an active pixel data element is received at the corresponding time point and a low logical value indicates otherwise. Edge detector 310 asserts hs-start output on the rising edge of the PLDE signal and the hs-end output on the falling edge of the PLDE signal.

Figure 4:
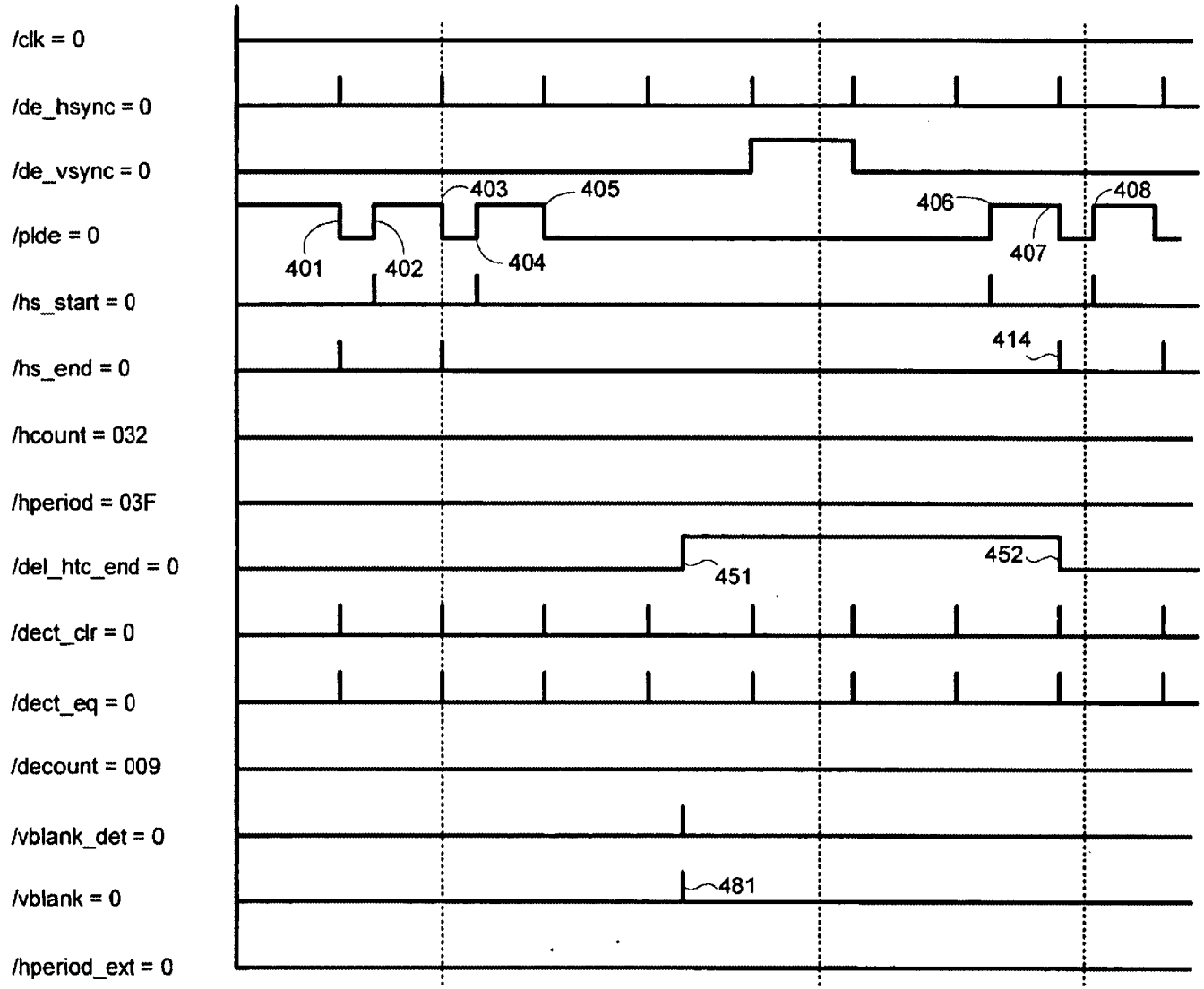
FIG. 4 is a timing diagram illustrating the operation of various components of the regeneration circuit of FIG. 3.

Thus, in FIG. 4, pulses are shown at time points 402, 404, 406, and 408 on the hs-start signal, and at time points 401, 403, 405 and 407 for the hs-end signal. Counter 320 is incremented by one for each sclk (source clock) clock cycle and is cleared by the hs-start signal (i.e., on the rising edge of PLDE signal). The output of counter 320 is shown as hcount in FIG. 4.

Register 330 stores the hcount value when AND gate 325 generates a high logical value. AND gate 325 accepts the hs_start signal and the inverted del_htc_end signal (described below). Due to the operation of AND gate 325, register 330 stores hcount value upon the occurrence of hs_start pulse (i.e., once each line when active pixel data elements are received), but the storing is prevented during the vertical blanking interval due to del_htc_end. Register 330 thus may store a constant value assuming the same number of pixels are received in successive lines. The output of register 330 is shown as hperiod signal in FIG. 4.

Multiplier 340 multiple hperiod value by two, and the multiplied value is provided as an input to comparator 350. The other input to comparator 350 is hcount. When the input from the multiplier equals the hcount value, the VSYNC is deemed to be detected on the assumption that if for two lines of time the DE does not go to a rising edge, then the vertical blanking interval has begun. Thus, vblank_det (output of comparator 350) is shown being asserted at time point 481, which is approximately two lines away from time point 404. As may be appreciated the time duration between 405 and 406 corresponds to the vertical blanking interval and time point 481 is fairly close to time point 405.

OR gate 360 receives as input the vblank_det signal and the output of flip-flop 370. The output of OR gate 360 is provided as an input to AND gate 365. AND gate 365 accepts the inverted hs_end signal also as the input. When the vblank_det pulse occurs, flip-flop 370 is set to one. As the output of flip-flop 370 is provided as input to OR gate 360, the output remains at a high logical level until the assertion of the hs_end signal. Thus, in FIG. 4, output signal of flip-flop 370 is shown as del_htc_end signal, and is shown going to a high logical state at time point 451 upon the occurrence of a pulse on the vblank_det signal (time point 481). The del_htc_end signal is shown going to the low logical state (at time point 452) upon the occurrence of hs-end pulse at time point 414.

The generation of the de_vsync signal is described after the description of the de_hsync signal.

OR gate 315 receives the hs_end signal and the output of comparator 395. The output (dect_clr in FIG. 4) of OR gate 315 clears counter 390. Counter 390 may thus be understood to count the number of pixels received since the reception of hs_end signal. The output of counter 390 is shown as de_count in FIG. 4. Comparator 395 generates a pulse when de_count equals hperiod. The output of comparator 395 is shown as dect_eq in FIG. 4. Flip-flop 398 buffers the dect_eq signal and provides the output as de_hsync. It should be noted that a de_hsync pulse is generated once every hperiod sclk clock cycles. As sclk represents the recovered dot clock, de_hsync may be viewed as a regenerated HSYNC signal.

Continuing with the generation of de_vsync, flip-flop 380 receives de_hsync on the enable input and del_htc_end on the data input. The output of flip-flop 380 is connected as data input to flip-flop 385. The enable input of flip-flop 380 is also connected to de_hsync. The output of flip-flop 380 and the inverted output of flip-flop 385 are connected as inputs to AND gate 388. The output of AND gate 388 corresponds to the de_vsync output. As may be readily observed, the de_vsync output is at a high logical level for one line as a result.

Figure 5:
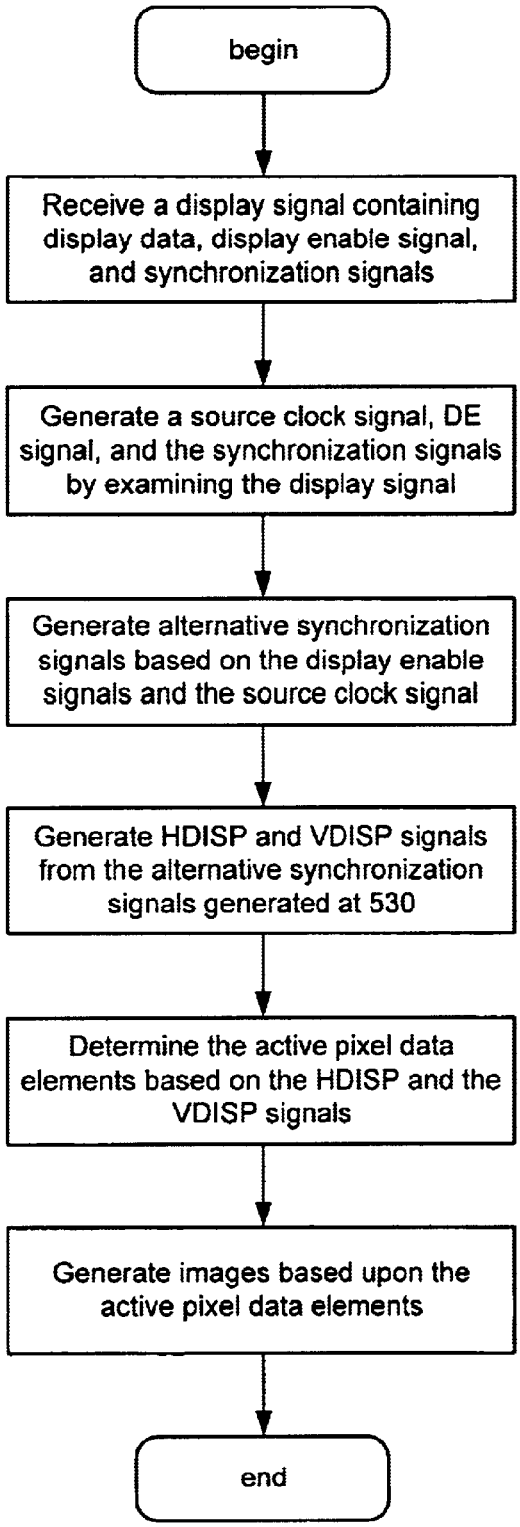
FIG. 5 is a flow chart illustrating a method in accordance with the present invention.

Thus, using a circuit such as that described above with reference to FIGS. 3 and 4, a display unit may be implemented in accordance with the present invention. FIG. 5 further briefly describes a method in accordance with the present invention.

4. Method

FIG. 5 is a flow-chart depicting a method in accordance with the present invention. The method begins in step 501, in which control immediately passes to step 510. In step 510, display unit 170 receives a display signal containing display data, display enable (DE) signal, and synchronization signals (HSYNC and VSYNC). In step 520, a source clock signal is generated by examining the display signal. The source clock signal may be generated in a known way. Similarly, the DE signal and synchronization signals may also be generated.

In step 530, alternative synchronization signals are generated based on the DE signal received in step 510. An embodiment generating the alternative synchronization signals (de_hsync and de_vsync) is described above with reference to FIGS. 3 and 4. In step 550, the display timing signals (HDISP and VDISP) representing the time durations in which an active pixel and an active line are available is generated.

In step 570, the active pixel data elements are determined based on the display timing signals generated in step 550. In step 580, the images are generated based on the active pixel data elements determined in step 570.

As the DE signal usually tracks the active pixel data in display signals, the active pixel data elements may be accurately identified, and the images displayed in accordance with the present invention may lead to superior image quality.

5. Conclusion

While various embodiments of the present invention have been described above, it should be understood that they have been presented by way of example only, and not limitation. Thus, the breadth and scope of the present invention should not be limited by any of the above-described exemplary embodiments, but should be defined only in accordance with the following claims and their equivalents.

What is claimed is:

1. A display unit receiving a display signal, said display signal containing each of display data, synchronization signals and display enable (DE) signal, said display data encoding a plurality of image frames, each of said plurality of image frames being represented by a plurality of active pixel data elements, said synchronization signals indicating the transitions across horizontal lines and image frames in said display data, said DE signal indicating a time duration in which said plurality of active pixel data elements are present in said display data, said display unit comprising:

a receiver receiving said display signal and generating a plurality of pixel data elements from said display data, wherein said plurality of pixel data elements contain said plurality of active pixel data elements;

a regeneration circuit receiving said DE signal and generating alternative synchronization signals based on said DE signal, wherein said alternative synchronization signals also indicating the transitions across horizontal lines and image frames;

a source timing measurement circuit receiving said alternative synchronization signals and generating a HDISP signal and a VDISP signal based on said alternative synchronization signals, wherein said HDISP signal indicates a time duration in which active pixel data elements are received and wherein said VDISP signal indicates a time duration in which an active horizontal line is received;

a scaler coupled to said source timing measurement circuit, said scaler receiving said plurality of pixel data elements and said HDISP signal and said VDISP signal, said scaler identifying said plurality of active pixel data elements in said plurality of pixel data elements based on said HDISP signal and said VDISP signal;

a display screen;

a panel controller coupled to said scaler and said display screen, said panel controller causing said plurality of image frames to be displayed on said display screen according to said plurality of active pixel data elements identified by said scaler; and a multiplexor located between said regeneration circuit and said source timing measurement circuit, said multiplexor receiving said synchronization signals received in said display signal and said alternative synchronization signals, said multiplexor providing either said synchronization signals or said alternative synchronization signals to said source timing measurement circuit, wherein said source timing measurement circuit generates said HDISP and VDISP signals based on the signals provided by said multiplexor, whereby said HDISP and VDISP signals to be generated based on either said synchronization signals or said alternative synchronization signals.

2. The display unit of claim 1, wherein said receiver generates source clock signal (SCLK) having a frequency equal to the frequency at which said pixel data elements are encoded in said display data and said source clock signal is provided to said regeneration circuit.

3. The display unit of claim 2, wherein said regeneration circuit comprises:

an edge detector to generate a hs_end signal pulse immediately when said DE signal indicates that said active pixel data elements are not present in said display data;

a first OR gate receiving said hs_end signal and a dect_eq signal;

a first counter being clocked by said SCLK, the clear input of said first counter being coupled to the output of said first OR gate;

a first comparator comparing the output of said first counter and a hcount value representing the total number of pixel data elements encoded in each horizontal line, said first comparator generating said dect_eq signal when an equality is detected; and a first flip-flop receiving said dect_eq on a data input and being clocked by said SCLK, the output of said first flip-flop being provided an alternative synchronization corresponding to a HSYNC signal contained in said synchronization signals received in said display signal.

4. The display unit of claim 3, wherein said regeneration circuit further comprises:

a second counter receiving a hs_start signal, wherein said hs_start signal is generated by said edge detector immediately when said DE signal indicates that said active pixel data elements are present in said display data;

a second counter clocked by said SCLK, a clear input of said second counter being coupled to said hs_start signal;

a register storing the output of said second register, an enable input of said register being coupled to said hs_start signal;

a multiplier multiplying the output of said register by an integer;

a second comparator comparing the output of said multiplier and said second counter, wherein said second comparator generates a vblank_det pulse indicating the detection of the presence of a VSYNC signal when an equality is determined in the comparison.

5. The display unit of claim 4, further comprising:

a second OR gate receiving said vblank_det signal and a del_htc_end signal;

a second flip-flop receiving the output of said second OR gate on a D input and generating said del_htc_end signal as an output;

a third flip-flop receiving said del_htc_end signal on a D input, and a fourth flip-flop receiving the output of said third flip-flop on a D input, wherein an enable input of both said third and fourth flops is coupled to the output of said first flip-flop; and an AND gate receiving in inverted output of said fourth flip-flop and the output of said third flip-flop, the output of said AND gate being provided as another alternative synchronization corresponding to a VSYNC signal contained in said synchronization signals received in said display signal.

6. The display unit of claim 1, wherein said display signal is received according to either Digital Visual Interface (DVI) or Digital Flat Panel (DFP) standard.

7. The display unit of claim 1, wherein said receiver comprises a TMDS receiver.

8. A display circuit for use in a display unit containing a display screen, said display circuit receiving a display signal, said display signal containing each of display data, synchronization signals and display enable (DE) signal, said display data encoding a plurality of image frames, each of said plurality of image frames being represented by a plurality of active pixel data elements, said synchronization signals indicating the transitions across horizontal lines and image frames in said display data, said DE signal indicating a time duration in which said plurality of active pixel data elements are present in said display data, said display circuit comprising:

a receiver receiving said display signal and generating a plurality of pixel data elements from said display data, wherein said plurality of pixel data elements contain said plurality of active pixel data elements;

a regeneration circuit receiving said DE signal and generating alternative synchronization signals based on said DE signal, wherein said alternative synchronization signals also indicate the transitions across horizontal lines and image frames;

a source timing measurement circuit receiving said alternative synchronization signal and generating a HDISP signal and a VDISP signal based on said alternative synchronization signals, wherein said HDISP signal indicates a time duration in which active pixel data elements are received and wherein said VDISP signal indicates a time duration in which an active horizontal line is received;

a scaler coupled to said source timing measurement circuit, said scaler receiving said plurality of pixel data elements and said HDISP signal and said VDISP signal, said scaler identifying said plurality of active pixel data elements in said plurality of pixel data elements based on said HDISP signal and said VDISP signal, wherein image frames on said display screen are generated based on said active pixel data elements identified by said scaler; and a multiplexor located between said regeneration circuit and said source timing measurement circuit, said multiplexor receiving said synchronization signals received in said display signal and said alternative synchronization signals, said multiplexor providing either said synchronization signals or said alternative synchronization signals to said source timing measurement circuit, wherein said source timing measurement circuit generates said HDISP and VDISP signals based on the signals provided by said multiplexor, whereby said HDISP and VDISP signals to be generated based on either said synchronization signals or said alternative synchronization signals.

9. The display circuit of claim 8, wherein said receiver generates source clock signal (SCLK) having a frequency equal to the frequency at which said pixel data elements are encoded in said display data and said source clock signal is provided to said regeneration circuit.

10. The display circuit of claim 9, wherein said regeneration circuit comprises:

an edge detector to generate a hs_end signal pulse immediately when said DE signal indicates that said active pixel data elements are not present in said display data;

a first OR gate receiving said hs_end signal and a dect_eq signal;

a first counter being clocked by said SCLK, the clear input of said first counter being coupled to the output of said first OR gate;

a first comparator comparing the output of said first counter and a hcount value representing the total number of pixel data elements encoded in each horizontal line, said first comparator generating said dect_eq signal when an equality is detected; and a first flip-flop receiving said dect_eq on a data input and being clocked by said SCLK, the output of said first flip-flop being provided an alternative synchronization corresponding to a HSYNC signal contained in said synchronization signals received in said display signal.

11. The display circuit of claim 9, wherein said regeneration circuit further comprises:

a second counter receiving a hs_start signal, wherein said hs_start signal is generated by said edge detector immediately when said DE signal indicates that said active pixel data elements are present in said display data;

a second counter clocked by said SCLK, a clear input of said second counter being coupled to said hs_start signal;

a register storing the output of said second register, an enable input of said register being coupled to said hs_start signal;

a multiplier multiplying the output of said register by an integer;

a second comparator comparing the output of said multiplier and said second counter, wherein said second comparator generates a vblank_det pulse indicating the detection of the presence of a VSYNC signal when an equality is determined in the comparison.

12. The display circuit of claim 11, further comprising:

a second OR gate receiving said vblank_det signal and a del_htc_end signal;

a second flip-flop receiving the output of said second OR gate on a D input and generating said del_htc_end signal as an output;

a third flip-flop receiving said del_htc_end signal on a D input, and a fourth flip-flop receiving the output of said third flip-flop on a D input, wherein an enable input of both said third and fourth flops is coupled to the output of said first flip-flop; and an AND gate receiving in inverted output of said fourth flip-flop and the output of said third flip-flop, the output of said AND gate being provided as another alternative synchronization corresponding to a VSYNC signal contained in said synchronization signals received in said display signal.

13. The display circuit of claim 8, wherein said display signal is received according to either Digital Visual Interface (DVI) or Digital Flat Panel (DFP) standard.

14. The display circuit of claim 8, wherein said receiver comprises a TMDS receiver.

* * * * *